US007114504B2

(12) United States Patent
Fox

(10) Patent No.: US 7,114,504 B2
(45) Date of Patent: Oct. 3, 2006

(54) COMBINED CIGARETTE PACK HOLDER AND ASHTRAY

(76) Inventor: Barry Fox, 2590 Sierra Vista La., Rescue, CA (US) 95672

( * ) Notice: Subject to any disclaimer, the term of this patent is extended or adjusted under 35 U.S.C. 154(b) by 303 days.

(21) Appl. No.: 10/427,893

(22) Filed: May 1, 2003

(65) Prior Publication Data

US 2004/0216753 A1 Nov. 4, 2004

(51) Int. Cl.
*A24F 19/10* (2006.01)

(52) U.S. Cl. ..... 131/238; 131/231; 131/235.1; 206/246; 206/496

(58) Field of Classification Search ..... 131/231, 131/238, 235.1, 239, 237.5, 242, 236, 256; 206/246, 264, 496; 220/523, 524, 525, 526
See application file for complete search history.

(56) References Cited

U.S. PATENT DOCUMENTS 2,069,400 A * 2/1937 Berg ..... 131/235.1
6,138,682 A * 10/2000 Lai ..... 131/231

OTHER PUBLICATIONS www.dictionary.com (website last updated on Jan. 26, 2005) (definition of mount—5 pages).*

* cited by examiner

*Primary Examiner*—Dionne W. Mayes

(57) ABSTRACT

A cigarette pack holder with an adjacent built-in ashtray section. The ashtray chamber is latterly adjacent the compartment for the cigarettes and extends downwardly and under the cigarette compartment. The ashtray section has a hinged cap that when in the closed position acts as a boss to engage a notch on the cover to secure the cover in place. The bottom of the device has a slider opening for removal of ashes. Spaced up from the bottom is a shelf to retain the cigarette or cigar pack. The ashtray is separated from the cigarette pack storage compartment by a heat resistant vertical wall. Other walls of the device should also be made of heat resistant material.

23 Claims, 5 Drawing Sheets

COMBINED CIGARETTE PACK HOLDER AND ASHTRAY

FIELD OF THE INVENTION

This invention pertains to a pocket-sized device that holds a package of conventional cigarettes or little cigars, and has a chamber for both the disposal of cigarette ashes and the receipt of cigarette butts.

BACKGROUND OF THE INVENTION

In today's society less and less people smoke, due to the recognition of the health hazard. Today's society is also requiring that cigarette smokers look after their cigarette ashes and butts, just as society is requiring dog lovers to clean up their dog's messes. In this new age of "take responsibility for yourself" there is indeed a market for a combination cigarette pack holder and ashtray. The invention of this application fills that need safely and easily and at a low price.

The invention accordingly comprises the device possessing the features, properties, and the selection of components which are exemplified in the following detailed disclosure, and the scope of the application of which will be indicated in the appended claims.

For a fuller understanding of the nature and objects of the invention, reference should be made to the following detailed description, taken in conjunction with the accompanying drawings.

SUMMARY OF THE INVENTION

A high temperature, plastic, device that is a combination cigarette pack or little cigar holder with an adjacent ash receiving chamber that can also store cigarette butts for a short term. The hinged cover body portion has a compartment to hold a conventional pack of 20 cigarettes, and an adjacent ash chamber which has a hinged cap to retain the ashes. The hinge of the ash chamber serves as the protrusion for the catch to retain the hinged cover of the device in a closed position. The ash chamber is preferably separated from the pack holding area both horizontally and vertically, for safety reasons. The ashes are removed through the bottom of the device, from a portion of the device beneath the cigarette pack by movement of a slider that opens the ash receiver to the environment.

It is a first object therefore to provide a combined cigarette pack/cigar pack carrier and ash chamber.

It is a second object to provide a cigarette pack ash receiver combination with a single cover that overlays both portions.

It is a third object to provide a temperature resistant plastic combination cigarette pack holder and ash chamber or ashtray wherein the ash chamber has its own cap to retain the ashes and smell within the ash chamber.

It is a fourth object to provide a combination cigarette pack holder and ash chamber wherein one attached cover closes off the cavity for the cigarette pack and the compartment for ash confinement.

Other objects of the invention will in part be obvious and will in part appear hereinafter.

DESCRIPTION OF THE PREFERRED EMBODIMENT

Figure 1:
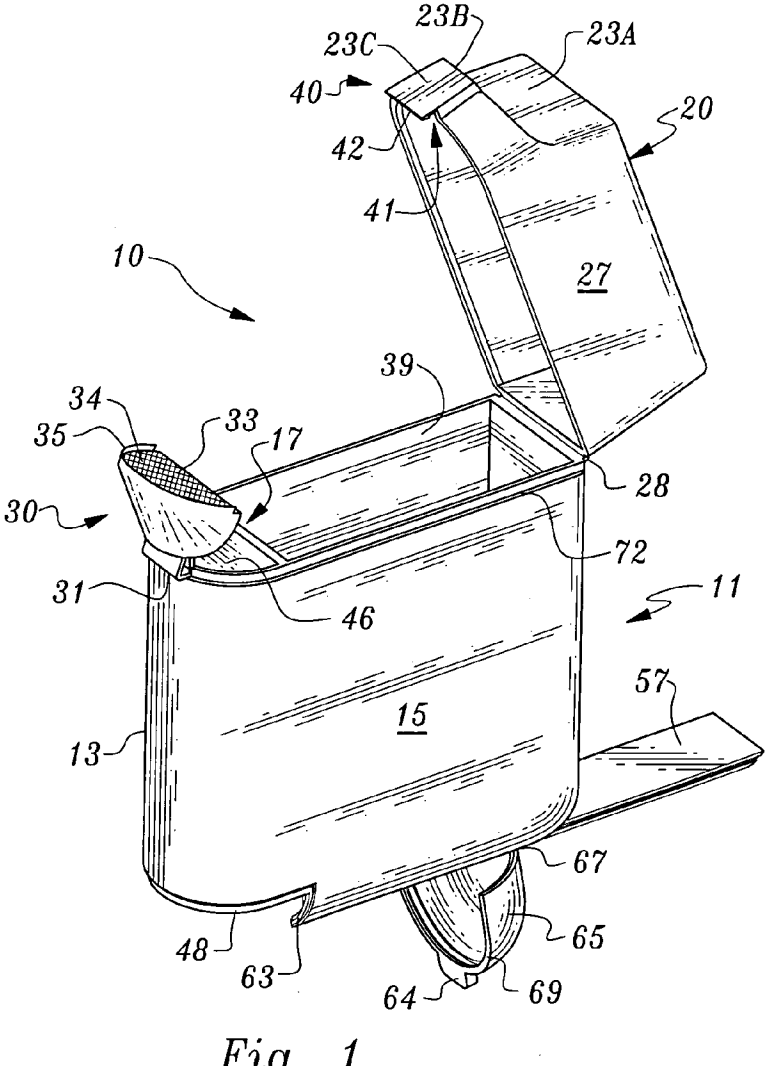
FIG. 1 is a right perspective view of the combined cigarette box holder and ashtray of this invention.

The discussion now moves to FIG. 1. Here the device 10 is seen. Device 10 has two portions, a body portion 11 and a cover 20.

The body 11 is an open top box having a rear wall 19 spaced from and generally parallel to a forward wall 13. Body 11 has two spaced side walls 12, 15, parallel to each other and at generally right angles to the rear and forward walls. The forward wall 13 is arcuate, preferably for enhanced aesthetics, while the rear wall 19 preferably has chamfered corners, again for enhanced aesthetics. A vertical divider panel 17 is spaced less from the forward wall 13 and more from the rear wall 19 to divide the body interior into a cigarette pack compartment 39 and an ash receiving chamber 46. See FIG. 11. The body portion is open at the top and includes a circumscribing recessed lip 72 on the front and side walls, such that when the cover 27 is engaged, it overlays body on the recessed lip 72. See FIG. 8. The bottom of the body portion will be discussed infra with respect to the discussion of FIG. 12. No lip is needed along the rear wall, as the hinge's presence ensures a water tight fit.

Figure 6:
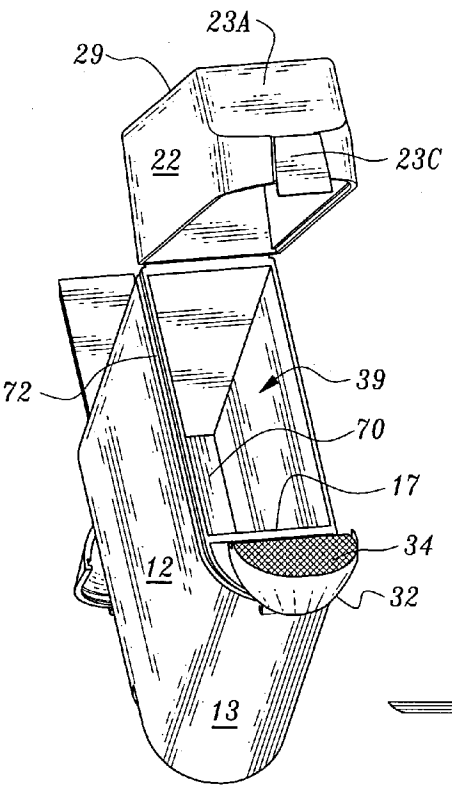
FIG. 6 is a top left perspective view of this invention.

The divider 17 extends from the top of the body portion 11 less than the full elevation of the body portion 10. See FIGS. 6,9 and 11. The vertical divider 17 is seen to terminate at its right angle intersection with shelf 18. Shelf 18 is spaced up from the bottom of the device, and is attached to the aforementioned rear wall at about a 90-degree angle as well as to the side walls.

Figure 2:
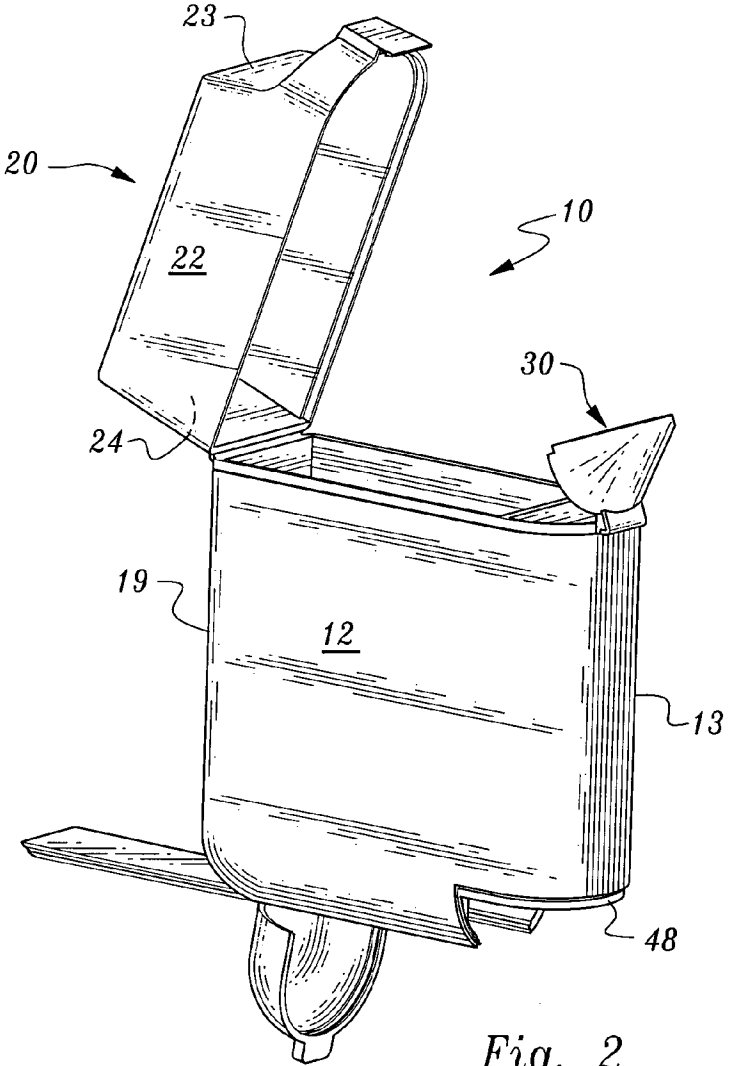
FIG. 2 is a left perspective view of the device of this invention.
Figure 10:
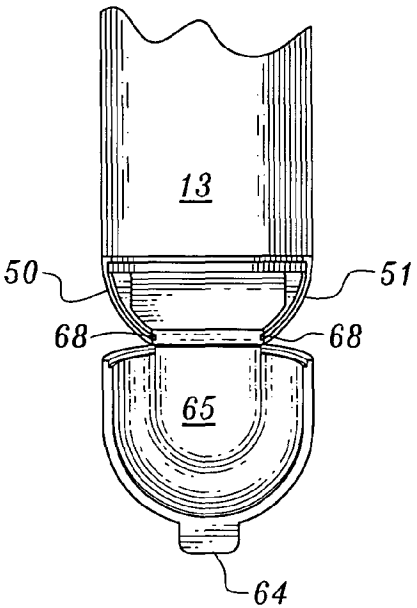
FIG. 10 is a lower front elevational view of this device.

Forward wall 13 may be set at a right angle to the two side walls, but preferably as shown in the figures is slightly arcuate for aesthetics. As seen in FIGS. 1 and 2, the body 11 has four walls all of the same elevation, 19,12,15, and 13. The rear wall includes a downward disposed lower curved section abutted thereto in a compound curve designated 19L. Indeed, the two side walls, 15 and 12 further include arcuate extensions 50 and 51, which extend down from the respective side walls and curve inwardly at their lower tips, but do not touch. These extensions, 50,51 extend forwardly from the rear wall lower curved section 19L to a point slightly rearwardly of divider 17. See FIGS. 3,6, and 10. The mode of closure, including details about slider 57, will also be discussed infra.

At the upper forward edge of front wall 13 at about the midpoint there is a hinge 31, for ashtray cap 30. This hinge—when folded, serves as the catch for the snap lock latch closure 40's recess 41 of the cover 20. More about the ashtray cap 30 infra. At the bottom of the arcuate front wall 13 is a recessed lip 48 which serves as a detent for bottom cover 65. See FIGS. 1, 2, and 3.

Figure 11:
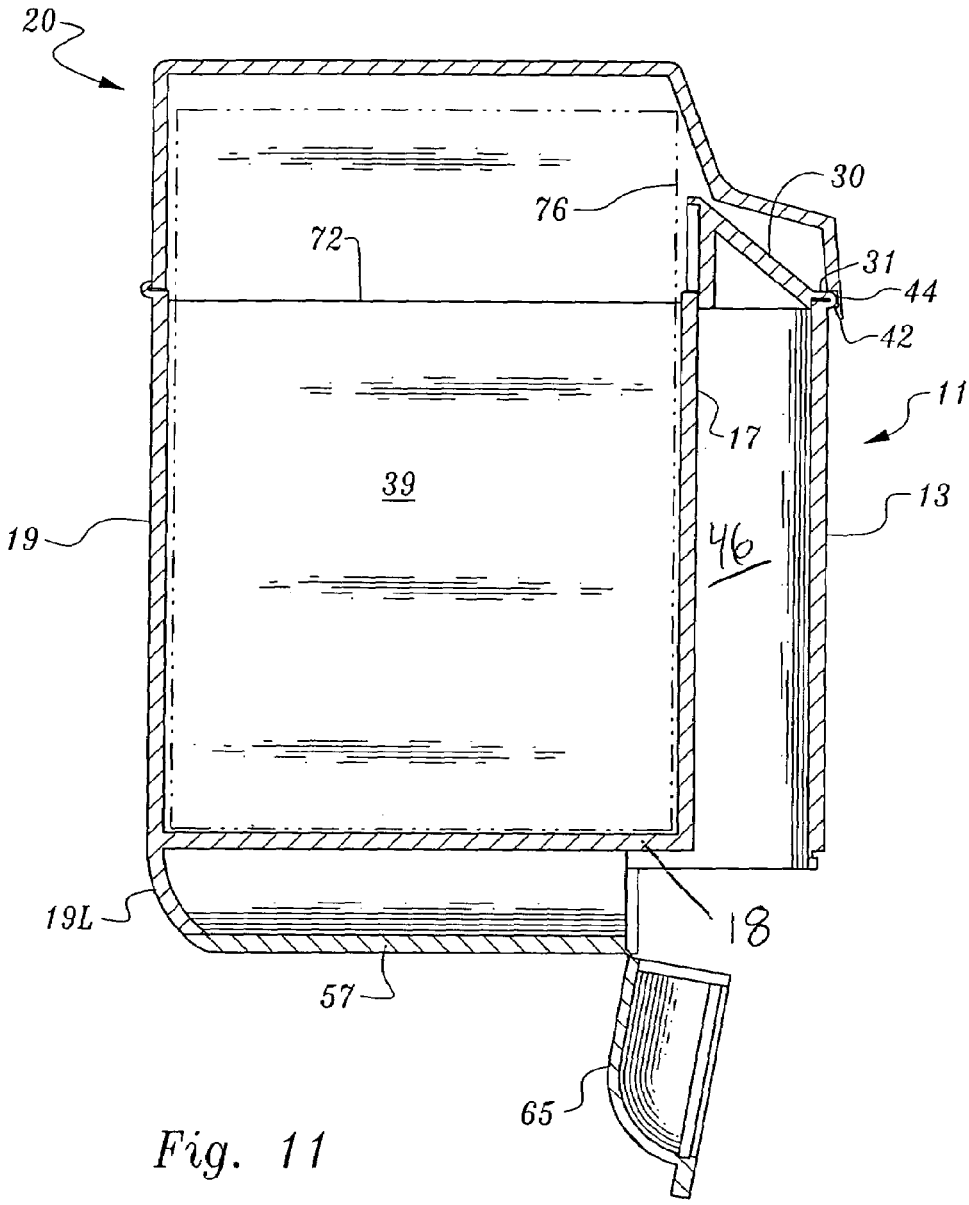
FIG. 11 is a cutaway left side elevational view showing the interior of the cigarette pack storage compartment and the ash chamber.
Figure 12:
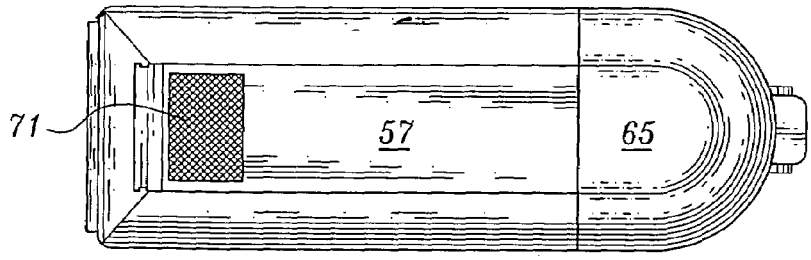
FIG. 12 is a bottom plan view of this device.

Body portion 20 is adapted to retain a conventionally sized package of twenty cigarettes within its cavity 39. The body portion can also be sized to accommodate a pack of 5 or 6 cigars. The vertical divider 17 sections off the ash receiving chamber 46, per FIGS. 1 and 7, from the cigarette storage area, 39 in the vertical direction. Shelf 18 as seen in FIG. 11 is a flat member that extends from a 90-degree intersection at the lower end of vertical divider 17 to the rear wall 19. Shelf 18 acts as a support for the cigarette pack not shown.

As noted above, extending between the top intersections of the side walls 12, 15, upon front wall 13 is a binge 31 for ash chamber cap 30. The cap 30 has a single arcuate side wall 32—FIGS. 3, 6—to which the binge is attached, a generally vertical rear wall 33 which resembles an orange section, and a somewhat horizontal flat top wall 34—FIG. 4—having hatching thereon in the figures, disposed normally to wall 33. These relative positions are based on the disposition of the cover 30 as seen in FIG. 1 and FIG. 2 among others when the cover 30 is not engaged. The surface 33, serves as the surface upon which a butt can be snuffed out. An upward extending lip 35, goes around the periphery of surface 34 to prevent cap 20 from being over inserted into the ash chamber. This lip will rest upon divider 17 to serve its intended purpose.

Figure 9:
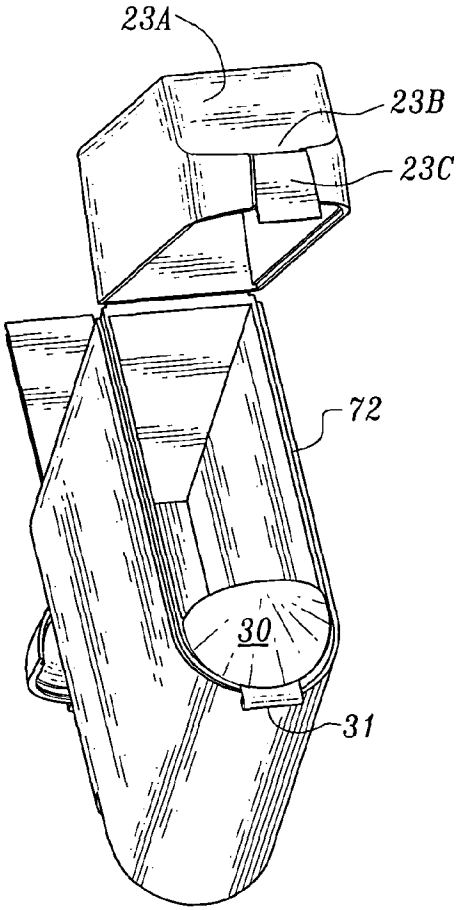
FIG. 9 is a view related to FIG. 6 but having the ash chamber cap closed.

In FIG. 9, the cover 30 is seen in the engaged position. Here the cover has rotated 90 degrees or so on the hinge such that the wall 34 has now assumed a generally vertical position, and is disposed within chamber 46, the ash receiving chamber, per FIGS. 1 and 11. Wall 34 now lays adjacent to and slightly spaced from one side of wall 17.

Hinge 31 when folded over when in the cover 30's engage position, extends slightly outwardly from the body portion to act as a catch for the engagement with the cover 20's latch closure 40's recess.

The cover 20 itself is also seen in this view. It is a stylized open bottom box having a rearward end 24—per FIG. 2, and sidewalls 27 and 22 respectively as seen in FIGS. 1 and 2. Hinge 28 also seen in these figures is disposed along the bottom edge of rear wall 24 and serves to connect the body portion 11 to the cover 20. Spaced from rear wall 24 and of the same total elevation dimension, is forward wall 23. This may be a flat surface disposed parallel to the rear wall and at right angles to the two spaced side walls 22 and 27 of the cover. But for aesthetics, it is preferred to have it stylized as shown in FIGS. 1 and 2 among others. Here forward wall 23 includes an upper forwardly sloping segment 23A that is recessed back from the absolute front of the cover 20; a generally horizontal intermediate segment 23B and a generally vertical third segment 23C. Preferably the interface between the spaced side walls and the front wall 23 of the cover 20 includes chamfered corners, rather than hard right angle corners.

Figure 8:
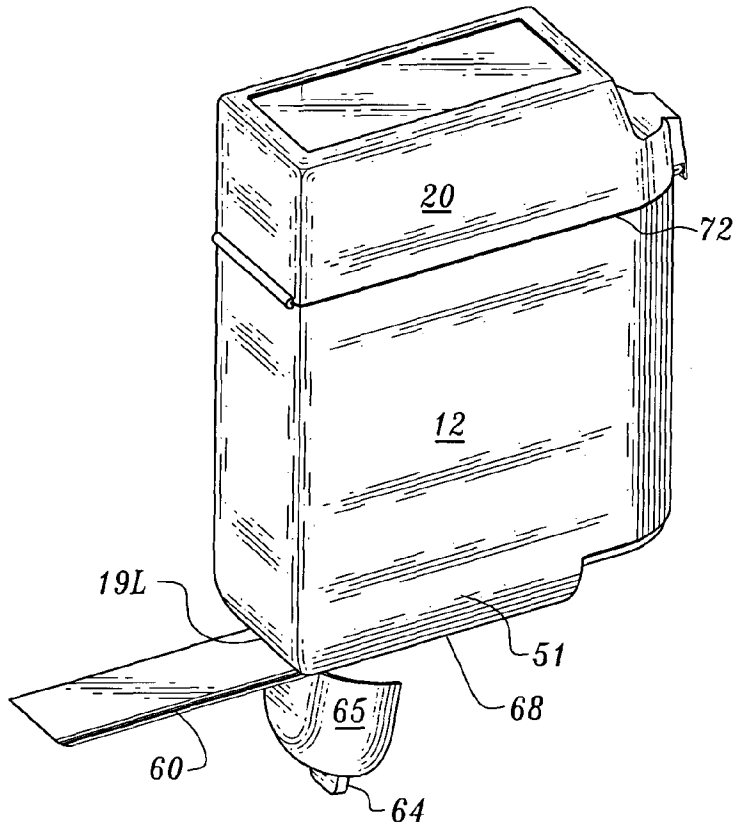
FIG. 8 is a left rear perspective view of the device with the cover closed.

The cover 20, which as noted is an inverted open bottom box, has a base 29 which when the cover is in the closed position, serves as the top of the device of this invention. Since the cover 20 is attached to the body portion by hinge 28, it can pivot along the hinge 28 to close off the body portion to retain the cigarette pack, inside the body portion as seen in FIG. 8.

At the opposite end of the cover 20 from the hinge attachment 28, is the forward end 23—when the vantage point is considered from the closed position of the device. Extending outwardly from the upper edge of the wall 23, is the catch closure 40 as denoted in FIGS. 1,6, & 7. This catch closure has a snap portion 41 that is flexible and the notch 42 which is adapted to engage the closed extended hinge 31 such that the cover not only overlays the body portion, but also the ashtray and the ashtray cap, once the cap 30 has been closed over the ashtray chamber. See FIG. 9 for ashtray closure and then FIG. 8 for total device closure.

Figure 4A:
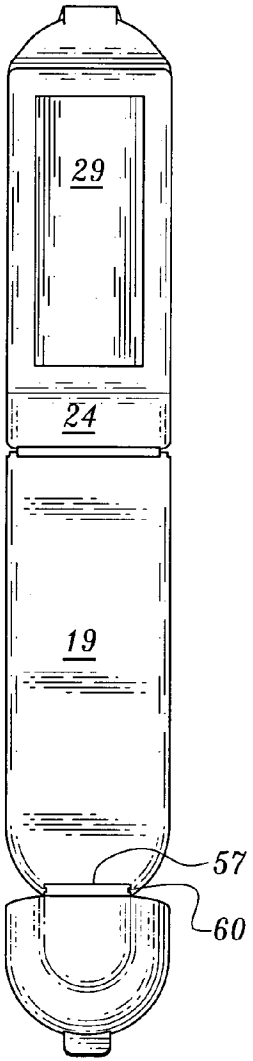
FIGS. 4, 4A are right-rear and rear perspective views, respectively, of this invention.
Figure 4:
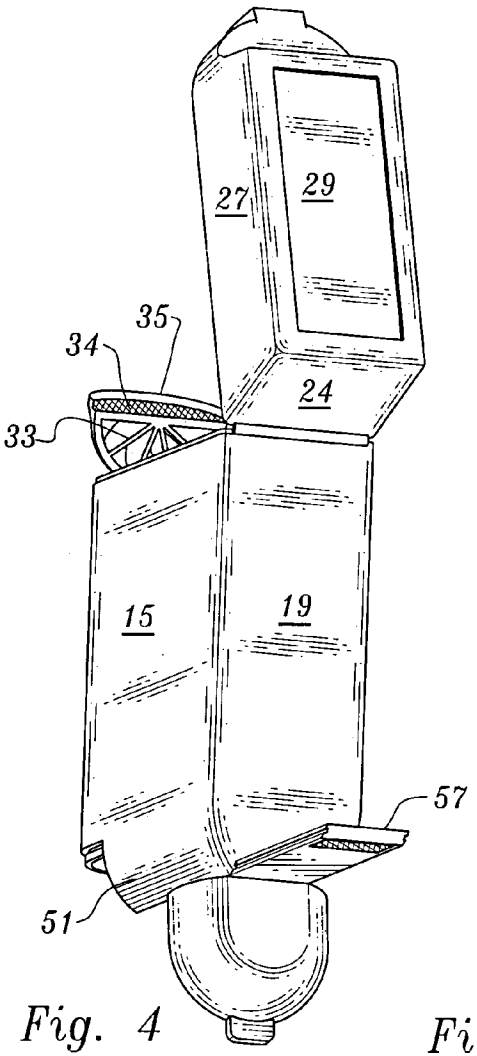

The discussion now turns to the slider 57 which is equal in elongation to the elongation of the arcuate sections 50,51. The slider 57 is generally rectangular and includes a groove 60 on each side located at about the midpoint of the elevation which is seen in FIG. 4. These grooves 60, are adapted to engage the respective elongated boss 68 that extends slightly outwardly from each of the two curved extensions 50,51 of the body section 11. These two elongated bosses 68 extend inwardly toward each other, but are spaced apart. These bosses are only about 1/16th inch or less, and are used to engage the respective grooves 60 such that the slider 57, when positioned on the two elongated bosses is retained from vertical movement relative to the bottom of the device, but can be moved by sliding horizontally to close off the space 70 seen in FIG. 8 beneath the shelf 18. When the slider 57 is inserted to the maximum from the rear of the device 10, along the aforementioned elongated bosses, the slider 57 will reach a stop point not visible in the figures, at point 63 which corresponds to the forward edge of each of side extensions, 50, 51.

Figure 3:
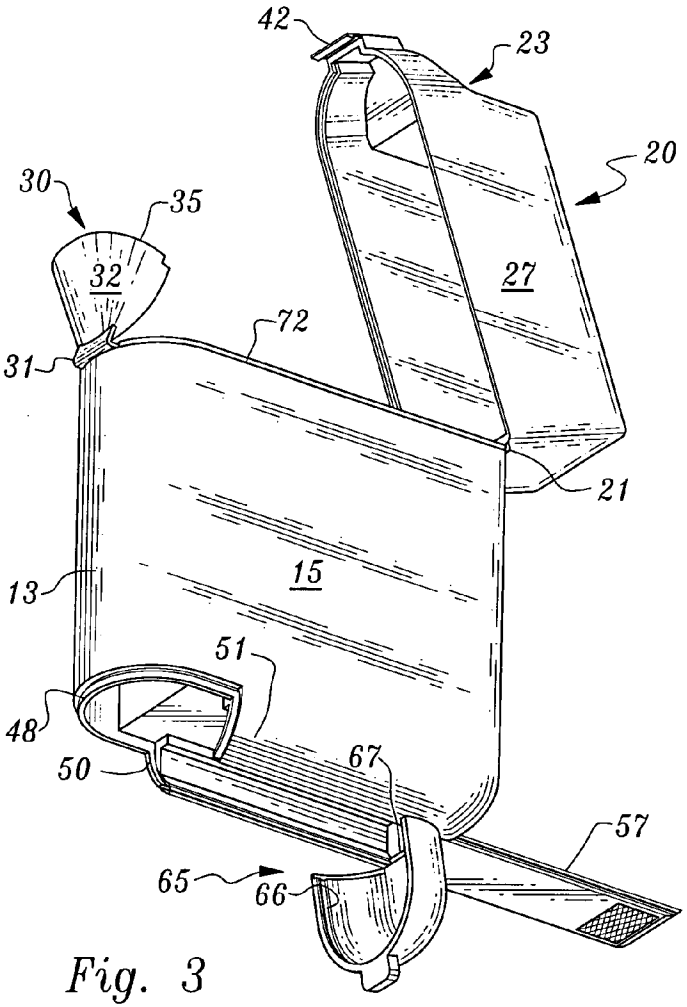
FIG. 3 is a right bottom perspective view of this invention.
Figure 7:
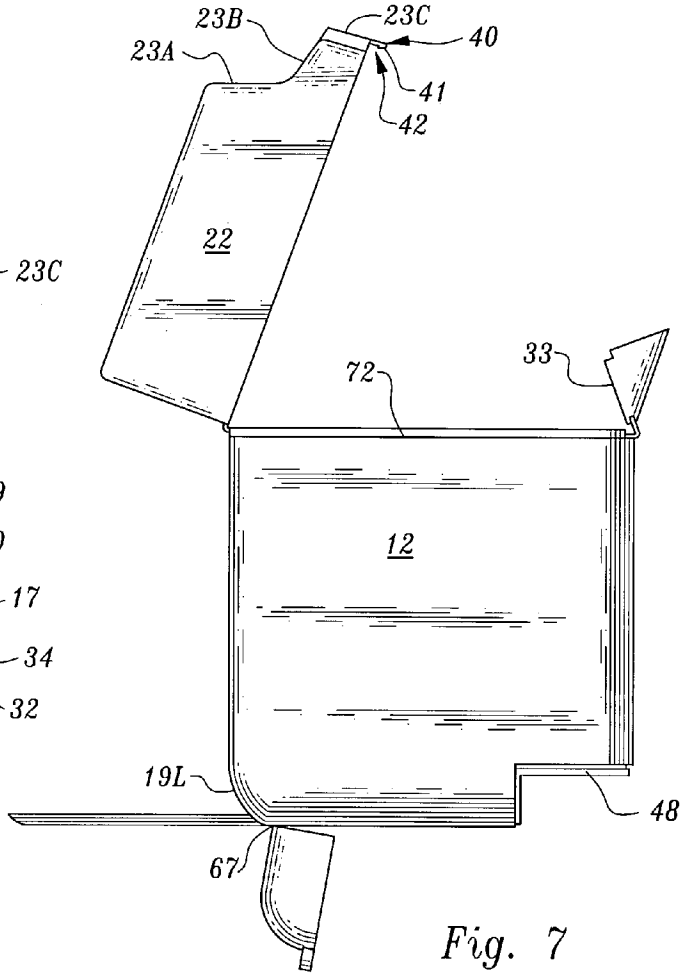
FIG. 7 is a view, related to FIG. 2 but seen from a slightly different vantage point.

Disposed at the forward edge of the slider 57 is a pivoting hinge 67, seen in FIGS. 1, 3 and 7. This hinge 67 is integrated to and formed during the molding of the slider, and is connected to bottom closure 65. This closure is configured as a quarter hemisphere, with the open side disposed facing the bottom of the device. The connection to the hinge 67 is at the apex of the closure 65. The circumscribing rim 39 see FIG. 1, at the lower end, i.e., distant from the hinge connection includes an interior inward extending section 66 which is adapted to engage lip 48 of the open bottom chamber by friction fit, to complete the closing off of the space beneath shelf 18 and to close off said chamber as well, which chamber is in communication with said space beneath the shelf 18.

An opener tip 64, seen in FIG. 1 may be included to speed up the engagement and disengagement of the bottom closure with lip 48 at the front of the device. This tip 64 is preferably long enough to catch the nail of a user to push the tip down to thereby open the catch to permit the slider to move.

Along this thought, knurling 71 may also be employed on the exterior surface of the slider to provide an assist for the user's finger to open the slider to remove ashes from beneath the shelf 18.

While shown as a quarter hemisphere, bottom closure 65 need not be this shape. The configuration shown lends itself to the overall aerodynamic look of the device of this invention. Thus when closed and engaged, a smooth flowing rear line is seen at the front of device 10.

The combined cigarette pack carrier and ashtray of this invention may be made entirely of heat resistant plastic. The ashtray section, defined by the vertical wall 17 and the shelf 18 as well as the slider should be so constructed for safety sake. Typical plastics that may be used include polyethylene, and high density polypropylene, among others. The plastic may be water white or a suitable colorant may be added during the molding process of manufacture. Among the colorants are suitable dyes to retain a transparency, or titanium dioxide for an opaque white color and carbon black for opaque black. If desired, a metallic liner or other suitable material may be placed as a sleeve within the ash receiving compartment, and a metal foil may be added to the surface of the slider, or at least to that portion of the slider that underlies the ashes receiving chamber.

The device of this invention leads itself to advertising placement by both cigarette manufacturers and companies offering the device as a giveaway present; for example, fine restaurants who want their patrons to smoke outdoors without littering the restaurant's premises with ashes and butts.

In addition, while intended primarily for cigarettes, the device of this invention can have its elevation increased, and its other dimensions changed appropriately to accommodate small cigar packages.

The discussion now continues with respect to the cover 20. Cover 20 is also an open box, which as shown in the position of FIG. 1, overlaid onto body portion 11.

The in use position of cover 20 is overlaid onto body position 11, which represents a difference of about 85 degrees from the position shown in FIG. 1. Compare FIG. 8 the closed position to FIG. 9 the cover being open and disposed at about 90 degrees from closing.

Figure 5:
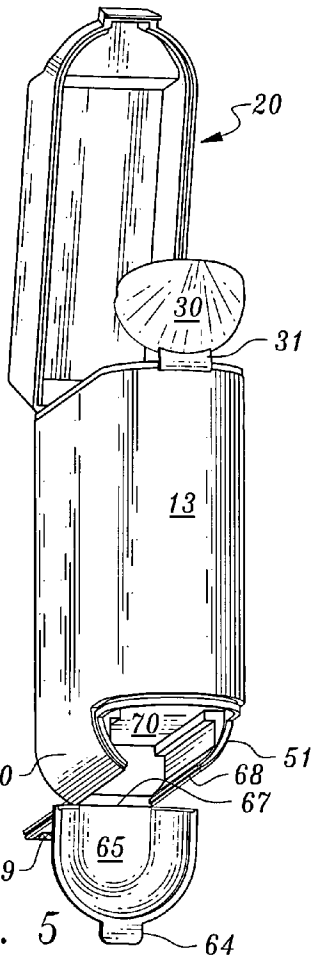
FIG. 5 is a front perspective view of this device.

Reference is made to FIG. 5, which better illustrates the curvature of the front wall 13, of the device. When the cover is closed, the hinge 31 is disposed in recess 41.

Slider 57 may also include a knurled area 59 for receipt of fingers or nails to facilitate transverse movement of the slider to expose the cavity 39 for ash removal. See FIG. 5 which shows the slider 57 partially extended. See supra.

In FIG. 11 a cigarette pack 39 is seen in phantom lines disposed within the cavity 39 and resting on shelf 18. Part of the pack sticks up above the top edge of the body portion 11. Part of the cigarette pack sticks above the top edge of the body portion, such that it is hidden only when the cover 20 is hingedly moved into position to overlie the body portion. The cap for the ashtray overlies the ashtray access and extends inwardly from the wall 13 to the vertical divider 17. The cap binge 31 acts as a boss when in the overlying position such that the detent 44's notch 42 can engage the edge of the hinge 31 to secure the cover over the body portion of the device Closure of the bottom when reversed, allows access to the area 34 under shelf 18 where ashes accumulate after being disposed in the ash chamber 46 beneath ashtray cap 30. See supra re tip to facilitate opening.

USE OF THE DEVICE

When a smoker desires to "light up" a cigarette, he or she will move the tab 42 slightly outwardly away from the body portion to un-secure the cover 20. The cover is then pushed back counterclockwise to expose and gain access to the contained cigarette or cigar pack in storage zone 39. A cigarette is lit and smoked, and instead of dropping the burning ashes on the floor or ground, the smoker removes the ashtray cap 30 by the use of a fingernail, rotates 30 out of the way on its hinge, and drops the ashes into the ashtray section of the body. The ashes will fall to the bottom of the cavity 34 for collection and removal through the slider into a safe disposal area, when a significant amount of ashes has accumulated. When the user has finished smoking, the cigar or cigarette butt may be snuffed out on surface 33 of the cap 30, and then placed in the ash chamber for future disposal. The cap and then the cover is restored into position such that the cover overlays the body at the recessed lip and the smoker t can then resume other activities.

While it is contemplated that the device will be made of heat resistant plastic, it is also within the scope of the invention to make it of metal such as light weight aluminum, in whole or in part.

While the cap covering over the ash chamber is shown hinged on the front wall, it is also within the scope of the invention to hinge it on the vertical divider. However, such a mounting offers less convenience to the user.

Since certain changes may be made in the described device without departing from the scope of the invention herein involved, it is intended that all matter contained in the above description and shown in the accompanying drawings shall be interpreted as illustrative and not in a limiting sense.

I claim:

1. A device for the receipt of a pack of cigarettes/cigars and for the stowage of ashes, comprising a body portion open at the top and at the bottom, and having a cigarette/cigar pack receiving compartment therein, and an adjacent ash receiving chamber, at least vertically separated from said compartment;

said ash receiving chamber having a vertically pivotably mounted cap adapted to close off only the ash receiving chamber, said cap having a flat top wall for snuffing out lighted smoking material, when said cover is not closing off said ash receiving chamber;

said body portion having a hinged cover which cover when closed overlies both the compartment and the chamber when said cap closes off said chamber;

and openable means closing off the bottom of said body portion to permit disposal of ashes that may be collected in said chamber.

2. The device of claim 1, wherein the ash chamber is separated from the cigarette pack compartment by a vertical divider attached to a horizontal shelf.

3. The device of claim 1, wherein the body portion includes a pair of opposed spaced arcuate sidewall extensions and the rear wall has a lower portion that intersects said sidewall extensions, and wherein the openable means is a slider that is disposed between said sidewall extensions, for movement between the rear and front of the device.

4. The device of claim 3, wherein the sidewall extensions are disposed from the rear of the device to a point substantially in line with the vertical divider, and the chamber is open at the bottom and includes a lip thereon;

and the slider includes a bottom closure pivotally attached thereto, said bottom closure having a rim engageable with said chamber's lip to close off the ash chamber.

5. The device of claim 4, further including an opener tip to aid in the opening of the bottom closure.

6. The device of claim 5, wherein the slider has an upper surface and a lower surface, and knurling is found on the lower surface.

7. The device of claim 3, wherein the arcuate extensions each include an elongated groove, and the slider has a pair of opposed outward extending elongated bosses, adapted to engage said grooves.

8. The device of claim 7, wherein the slider additionally includes a hinged bottom closure, at its forward end, which closure may include a nail tip to render the movement of the bottom closure easier.

9. The device of claim 8, wherein the front wall is arcuate and the rear wall has chamfered corners.

10. The device of claim 3, further including a slider to close off the bottom of device, and wherein the arcuate extensions each include an elongated groove adapted to engage the slider for movement along the grooves.

11. The device of claim 3, wherein the device is made of a plastic selected from the group consisting of polyethylene and polypropylene.

12. The device of claim 3, wherein the device is made of a plastic selected from the group consisting of polyethylene and polypropylene with a colorant therein.

13. The device of claim 12, wherein the slider has a bottom surface and the bottom surface includes knurling.

14. The device of claim 1, wherein the body portion includes a recessed top lid, such that when the cover is engaged, it overlays the body slightly.

15. A device for the receipt of a pack of cigarettes/cigars and for the stowage of ashes, comprising a body portion having a front wall, and spaced side walls and a rear wall parallel to said front wall, open at the top and at the bottom, and having a cigarette/cigar pack receiving compartment therein, and an adjacent ash receiving chamber disposed forwardly of the cigarette/cigar compartment, which ash receiving chamber is both vertically and horizontally separated from said compartment, by a vertical divider and a horizontal shelf respectively;

said ash receiving chamber having a vertically pivotably mounted cap mounted to the top of the front wall adapted to close off only the ash receiving chamber, said cap having a flat top wall for snuffing out lighted smoking material, when said cover is not closing off said ash receiving chamber;

and said body portion having a cover hinged to the top of the rear wall which cover when closed overlies both the compartment and the chamber when said chamber cap has closed off the top of the ash receiving compartment.

16. The device of claim 15, wherein the front wall of the body portion is arcuate and the front wall of the cover is stepped in configuration.

17. The device of claim 15, wherein the horizontal shelf intersects the rear wall at the bottom edge thereof, and further including a rear lower portion, which commences at the intersection of the shelf and rear wall and extends down and forwardly to a pair of spaced arcuate sidewall extensions, which extensions terminate at a point substantially vertically in line with the vertical divider to define a space beneath the horizontal shelf.

18. The device of claim 15, wherein the slider additionally includes a hinged bottom closure, at its forward end, which closure may include a nail tip to render the movement of the bottom closure easier.

19. A device for the receipt of a pack of cigarettes/cigars and for the stowage of ashes, comprising a body portion having an arcuate front wall, and spaced side walls and a rear wall parallel to said front wall, said rear wall having chamfered corners, said device being open at the top and at the bottom, and having a cigarette/cigar pack receiving compartment therein, and an adjacent ash receiving chamber disposed forwardly of the cigarette/cigar compartment, which ash receiving chamber is both vertically and horizontally separated from said compartment, by a vertical divider and a horizontal shelf respectively;

said ash receiving chamber having a vertically pivotably mounted cap sized to engage said chamber to close off only the ash receiving chamber, said cap having a flat top wall for snuffing out lighted smoking material, when said cover is not closing off said ash receiving chamber;

said body portion having a cover hinged to the top of the rear wall, and the front wall of the cover is stepped in configuration, which cover when closed, overlies both the compartment and the chamber when said chamber cap has closed off the top of the ash receiving compartment;

said body portion also including a pair of spaced mirror image arcuate sidewall extensions which define a space beneath said shelf, which space communicates with said chamber;

and means for disposition between said sidewall extensions to close off the space beneath said shelf.

20. The device of claim 19, wherein the means for disposition between said arcuate extensions is a slider having a top side and a bottom side, the bottom side being knurled.

21. The device of claim 20, wherein the arcuate side wall extensions extend from the rear of the device to a point substantially equal to a point beneath the vertical divider;

and said slider further includes a hinged bottom closure having a nail tip thereon, for closing off said chamber.

22. The device of claim 19, wherein the cap includes both a surface upon which a butt can be snuffed out and a lip to prevent over-insertion during engagement with said chamber.

23. The device of claim 19, wherein the body portion includes a recessed top lid, such that when the cover is engaged, it overlays the body slightly.

* * * * *